United States Patent [19]

Gonzalez Espinosa de Los Monteros

[11] 4,214,413

[45] Jul. 29, 1980

[54] BUILDING STRUCTURE

[76] Inventor: Emilio Gonzalez Espinosa de Los Monteros, Alamedade Colon nums, Malaga, Spain

[21] Appl. No.: 25,487

[22] Filed: Mar. 30, 1979

[30] Foreign Application Priority Data

Jun. 8, 1978 [ES] Spain ..... 470621

[51] Int. Cl.[2] ..... E04H 1/04

[52] U.S. Cl. ..... 52/236.1; 52/236.4

[58] Field of Search ..... 52/79.2, 185, 182, 190, 52/175, 176, 79.8, 79.9, 79.4, 236.1

[56] References Cited

U.S. PATENT DOCUMENTS

| | | | |
|---|---|---|---|
| 3,608,257 | 9/1971 | Lopez | 52/236.4 |
| 3,618,278 | 11/1971 | Mouton | 52/236.7 |
| 3,805,461 | 4/1974 | Jagoda | 52/185 |
| 3,830,026 | 8/1974 | Tylius | 52/185 |
| 3,875,710 | 4/1975 | Dawson | 52/236.7 |

FOREIGN PATENT DOCUMENTS

| | | | |
|---|---|---|---|
| 1094959 | 12/1960 | Fed. Rep. of Germany | 52/182 |

*Primary Examiner*—John E. Murtagh

*Attorney, Agent, or Firm*—Bacon & Thomas

[57] ABSTRACT

A building structure includes columns for supporting pairs of beams at staggered height intervals. Slabs are supported between the beams of each pair of beams to form floors and ceilings and pairs of adjoining panels extend obliquely between the pairs of beams to form sidewalls. The individual panels of each pair have horizontally extending lip portions with spaces therebetween. The lip portions rest on the beams to support the panels and are received within the spaces between the lip portions of adjoining panels.

7 Claims, 7 Drawing Figures

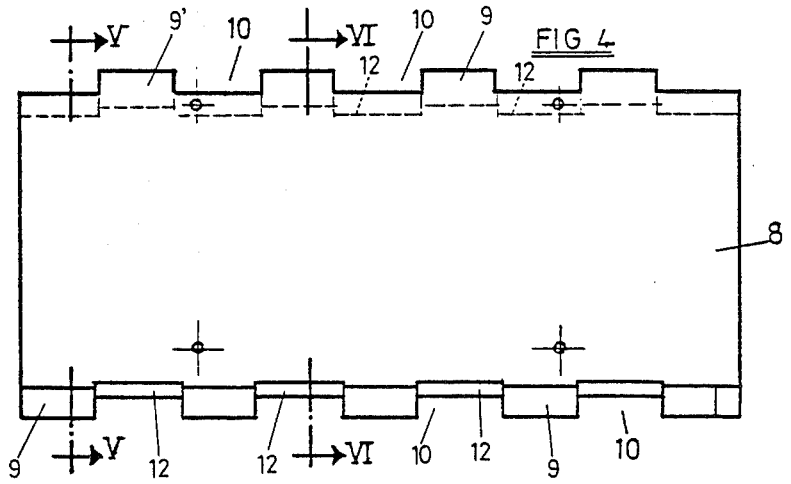
FIG 4
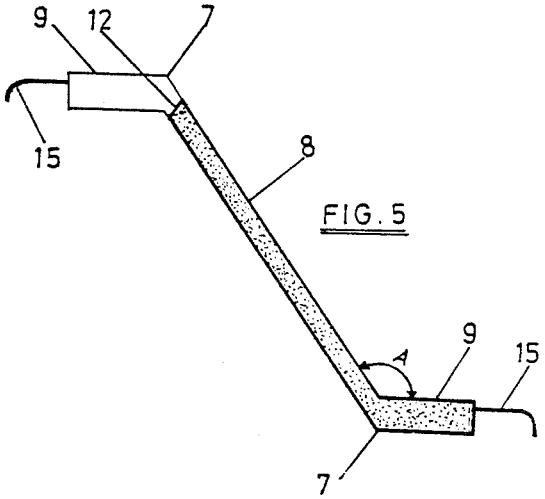
FIG. 5
FIG. 6
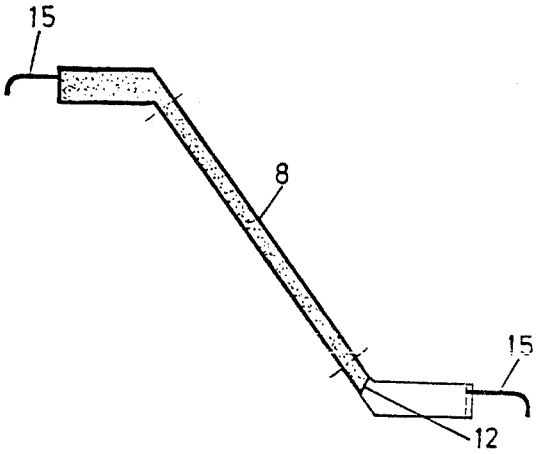

BUILDING STRUCTURE

BACKGROUND OF THE INVENTION

This invention pertains to a system for the construction of housing dwellings having useable spaces or cavities defined by hexagonal horizontal prisms, two of which have parallel faces lying horizontal so as to define the floor and ceiling of each habitable cavity or space.

Housing of this type is already known and is described, for example, in Spanish Pat. No. 355,954 which describes a procedure for building housing wherein the useable or habitable space consists of hexagonal, horizontal prisms arranged as described above.

The two horizontal parallel walls of the prism consist of a number of similar forged pieces which form the floor and ceiling of each habitable space. In the lengthwise direction, the prism is bounded on either side by two inclined walls consisting of, for example, prefabricated panels.

The structure of this type of housing consists of vertical pillars and horizontal beams. The horizontal beams run precisely along the edges of the hexagonal prisms and support the horizontal forged pieces and the inclined panels, and the horizontal beams are in turn supported by the vertical pillars.

The inclined pillars and the forged piece which come together at any given horizontal beam may be joined in any of several ways, such as that, for example, described in Spanish Pat. No. 438,471, to the same applicant. In accordance with this patent, horizontal beams are provided on one side with a bracket to support the forged piece and provided on the other side with one inclined end step to support each panel.

This prior art construction system has a drawback in that the spacing between the beams which support the forged pieces must be small, since too large a separation would require considerable reinforcement of the forged pieces.

Another problem arising in the construction of housing of the above-mentioned type lies in the fact that the inclined panels which constitute the walls of the habitable spaces rest at an angle on the horizontal beams.

SUMMARY OF THE INVENTION

An object of this invention is to achieve a system for the construction of housing of the above-mentioned type, wherein wider modules or habitable spaces can be provided without having to resort to increasing the strength of the floor forged pieces.

A further object of this invention is to achieve a simple system for coupling and joining together inclined panels and horizontal beams.

Yet another object of the invention is to achieve a simple, solid joining of inclined panels and forged pieces with horizontal beams without having to resort to welding.

Still another objective of the invention is to achive a structure having inclined components which, once they have been joined together throughout their length, form an assembly of folded beams which, together with the beams of girders of the structure itself, provide a significant earthquake proof factor.

In accordance with the invention, the panels which constitute the inclined walls have two parallel edges which run horizontally in a finished dwelling. The edges define three consecutive plane areas, namely a center area, whose size is the same as that of each inclined wall, and two equal and rectangular end areas, which are parallel to one another and to the forged pieces, so that the rectangular end areas lie horizontally.

Starting at their free longitudinal face, the end areas are provided with a series of recesses and projections designed to mesh together with the projections and recesses of a similar piece so as to form a "rack" precisely where the beam is supported. The bottom of the gaps is defined by the intersection of the inclined walls which meet at each edge.

The inclined walls rest upon the horizontal beams precisely at the location of the projections which lie horizontally.

The rack thus formed rests on the beam and at the same level as the forged piece which also rests on the beam, whereby the floor or ceiling is defined by the corresponding forged piece and by the end strips or areas obtained as the projections and recesses of each pair of panels mesh together.

In the system according to the invention, the horizontal beams do not run along the edges of the hexagonal prisms which constitute the habitable spaces but rather run parallel to the edges while being slightly separated from them, so that the resulting floor and ceiling is wider than the forged piece.

This arrangement makes it possible to obtain a greater width for the inhabitable spaces without excessively enlarging the separation between horizontal beams.

Another advantage obtained with the system according to the invention is that the support system of the inclined panels on the horizontal beams is simplified.

The inclined panels, forged pieces and horizontal beams are joined monolithically by making the front of the projections which rest on a given beam separate from the front of the forged piece which rests on the same beam, thus delimiting on the beam a central channel to which reach the reinforcements of the panels, the forged piece and the beam itself. This channel is later concreted so that it will be flush with the forged piece and the projections, a perfect monolithic union thus being obtained among the various components which meet at each horizontal beam.

The characteristics and advantages discussed above will become more clearly evident through the following description, which refers to the attached drawings wherein a possible embodiment is shown by non-restrictive examples.

BRIEF DESCRIPTION OF THE DRAWINGS

FIG. 4 is an elevational view of a panel from which the inclined walls of the habitable spaces showing in FIGS. 1, 2 and 3 are obtained.

FIG. 5 is a sectional view taken along line V—V of FIG. 4.

FIG. 6 is a sectional view taken along line VI—VI of FIG. 4.

DETAILED DESCRIPTION

Figure 1:
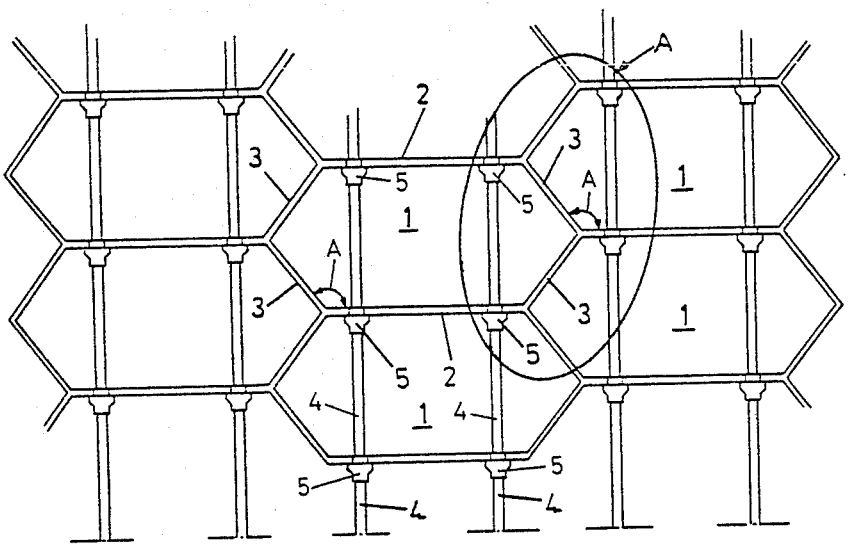
FIG. 1 is an elevational view of a structure built in accordance with the principles of the present invention.

As can be seen in FIG. 1, the habitable spaces of the dwellings consist of hexagonal, horizontal prisms, designed generally by the number 1. The prisms have two of their parallel faces or planes, designated by the numeral 2, in a horizontal position in order to define the ceiling and the floor slabs for each habitable space, while the other four faces or planes, designated by the numeral 3 laterally delimit with each pair the habitable space 1, there being always a plane in common between any two consecutive spaces.

The bearing structure of this housing is composed of vertical columns or pillars 4 and horizontal beams 5 which rest on the pillars 4 and run parallel to and spaced from the longitudinal edges of the hexagonal prisms 1. There are first and second pairs of horizontal beams 5 wherein the pairs are supported by the columns 4 at first and second height intervals midway between one another.

Figure 2:
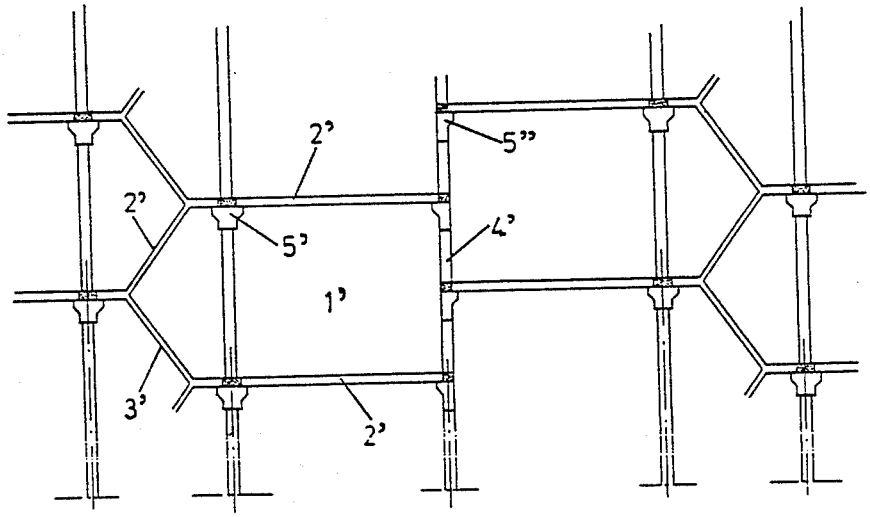
FIG. 2 is a view similar to that of FIG. 1 depicting a modified embodiment.

The hexagonal prisms of the housing depicted in FIG. 1 may be converted to pentagonal prisms such as those shown in FIG. 2, which also have two parallel horizontal slabs 2′ so that the habitable space 1′ is delimited on one side by two inclined walls or planes 3′ and on the other side by a vertical plane extending between two pillars 4′. The bearing structure of FIG. 2 also includes pillars 4′ and horizontal beams 5′, which are provided with a bracket on one side only. FIG. 2 provides an idea of variations that can be introduced in the housing construction system based on hexagonal horizontal prisms.

Figure 3:
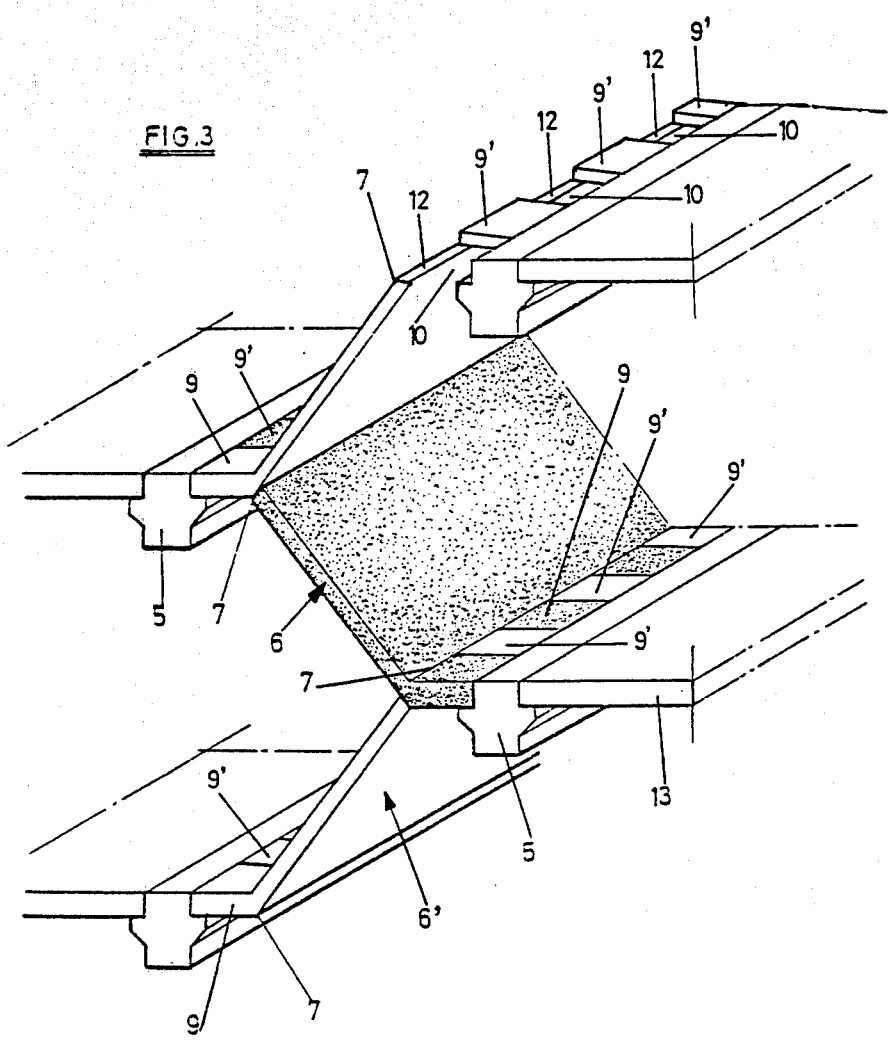
FIG. 3 is a partial perspective view, on a larger scale, of a detail of FIG. 1; in which pillars are not shown for simplicity, although the ends of the horizontal beams logically rest, according to the invention, on the pillars of the construction, which are concreted in place in accordance with known procedures in order to join the projecting reinforcements of the beams with the reinforcements of the pillars.

With reference to FIG. 3, it can be seen that the inclined walls of the habitable spaces are composed of pairs of adjoining inclined panels 6 which, as may be seen better in FIGS. 4, 5 and 6, have two edges 7 parallel to the support beams 5 which edges define top and bottom ends of the panel 6. These edges delimit three areas in the panel, namely one intermediate wall area designated by the numerals 8, equal in size to the inclined walls 3, and two rectangular end areas or lip portions 9, equal and parallel to one another with spaces therebetween. The end areas or lip portions 9 form with the intermediate area 8 an angle A equal to the angle A formed between the inclined walls 3 and the horizontal planes or faces 2 of each habitable space 1 of FIG. 1, in such a fashion that the lip portions 9 will remain horizontal while the wall areas extend obliquely between as can be seen in FIG. 3.

Furthermore, starting from their free face, the lip portions 9 are provided with spaces 10 therebetween which delimit between themselves intermediate lip portions 9. The spaces 10 are bounded on the inside by a surface corresponding to the intersection of the two inclined walls which come together at a given edge, said surface being designated by the numbers 12 in FIGS. 5 and 6. Moreover, the spaces 10 are slightly wider than the lip portions 9 to allow for slight adjustments as the building is assembled by providing gaps between meshed lip portions.

By means of this arrangement, the lip portions 9 and 9′ of the panels 6 and 6′ which come together at a given edge (see FIG. 3) are joined to each other and lie horizontally so as to rest on the beams 5, so that the lip portions 9 and 9′ thus become part of the horizontal slabs 2 of each habitable space.

The rest of the slabs or horizontal planes forming floors or ceilings consist of the intermediate forged pieces or slabs 13 each of which is supported by a pair of parallel beams 5.

In accordance with the construction described above, therefore, the ceiling and floor of each habitable space includes a middle, larger portion consisting of the forged pieces 13, and the end portions or strips delimited by the lip portions 9 and 9′ of the corresponding inclined panels. Accordingly the floor and ceiling are wider than the forged pieces 13.

Figure 7:
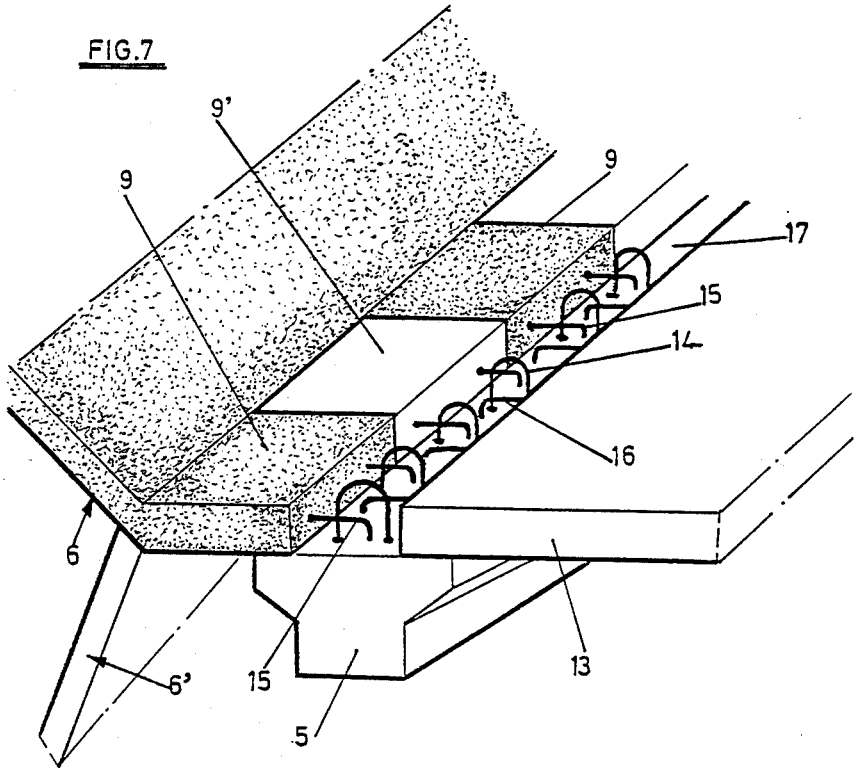
FIG. 7 is a perspective view of a beam and of the components which meet at the beam.

In order to obtain a monolithic union of the various elements which comprise the construction, the top surface of the beams 5 are bare as shown in FIG. 7 so that reinforcements 14 in the beam are exposed. Similarly, the reinforcing rods 15 and 16 extend outward from the free face of the portions 9 and 9′ and from the forged piece 13.

As they rest on the beam 5, the free faces of the portions 9 and 9′ and of the forged portion 13 define a longitudinal channel 17 which is filled with concrete to form a monolithic union of the beam, forged piece inclined panels.

Preferably, the upper and lower panels 3 are identical with the lip portion 9 on the top end 12 being aligned with the spaces 10 on the bottom end and with lip portions on the bottom ends beign aligned with the spaces 10 on the top ends. As the building is assembled, the upper members of each pair of panel members are reversed with respect to the lower members and vice versa.

The afore described embodiments and examples are for illustrative purposes only and the invention is limited only by the following claims.

I claim:

1. A system for constructing a building comprising:
a plurality of vertical columns;
first pairs of horizontal beams supported by the columns at first height intervals;
second pairs of horizontal beams supported by the columns at second height intervals midway between the first height intervals;
horizontal slabs extending between the beams of each pair of beams and supported thereon to form floors and ceilings, and
pairs of adjoining panel members extending obliquely between the first and second pairs of beams to form walls, wherein each panel member has top and bottom ends with horizontally extending lip portions disposed along the ends with spaces between the lip portions, which lip portions rest upon the beams to support the panel members and which lip portions are alternately spaced on adjoining panel members with the lip portions on one member being received in the spaces between the lip portions of the other member.

2. The system of claim 1 wherein the beams, slabs and oblique panel members are concrete, wherein reinforcing members object therefrom and wherein the lip portions and slabs rest upon the columns with a space therebetween which space receives the reinforcing members and which space is filled with concrete to form a monolithic structure.

3. The system of claim 1 or claim 2 wherein the lip portions at the top end of each panel member are aligned with the spaces at the bottom end of each panel.

4. The system of claim 1 or 2 wherein the individual panel members of each pair of panel members are substantially identical to one another with upper member being reversed with respect to the lower member, whereby the lip portions of the upper member are received in the spaces of the lower member and vice versa.

5. The system of claims 1 or 2 wherein the individual panel members of each pair of panel members are substantially identical to one another with upper members being reversed with respect to the lower members and with the lip portions being wider than the spaces, whereby the lip portions of the upper members are received in the spaces of the lower member with a gap between each lip portion and adjacent lip portions wherein the gap permits adjustment of the panel members with respect to one another during assembly of the structure.

6. The system of claims 1 or 2 further including vertical panels opposite each pair of adjoining panel members to define a pentagonal rooms.

7. The system of claims 1 or 2 wherein the pairs of adjoining panel members form opposed walls within the building to define hexagonal rooms.

* * * * *